US006175203B1

(12) United States Patent
Liao

(10) Patent No.: US 6,175,203 B1
(45) Date of Patent: Jan. 16, 2001

(54) ELECTRIC CARRIER WITH A MOTOR CONTROLLED BY CORRELATIVE POSITIONS

(76) Inventor: Gordon Liao, No. 5, Alley 54, Lane 737, Chung Jeng North Road, Yung Kang City, Tainan Hsien (TW)

( * ) Notice: Under 35 U.S.C. 154(b), the term of this patent shall be extended for 0 days.

(21) Appl. No.: 09/301,684

(22) Filed: Apr. 28, 1999

(51) Int. Cl.[7] ..... G05G 7/00
(52) U.S. Cl. ..... 318/280; 318/281; 318/685
(58) Field of Search ..... 318/139, 280–296, 318/685, 551, 587; 180/19.3, 6.5, 168, 65.5, 332, 165, 65.1, DIG. 5, 191, 208; 280/646, 652

(56) References Cited

U.S. PATENT DOCUMENTS 3,830,325 * 8/1974 Tarter ..... 180/14
3,941,198 * 3/1976 Kappas ..... 180/11
4,081,047 * 3/1978 Lovell et al. ..... 180/19 H
4,106,583 * 8/1978 Nemeth ..... 180/65 E
4,185,711 * 1/1980 Lawrence et al. ..... 180/214
4,427,084 * 1/1984 Savard ..... 180/19 H
4,538,696 * 9/1985 Carter ..... 180/19.3
4,570,731 * 2/1986 Oaks ..... 180/19.3
4,615,406 * 10/1986 Bottenschein et al. ..... 180/191
4,639,667 * 1/1987 Andersen ..... 324/208
4,848,504 * 7/1989 Olson ..... 180/191
5,526,894 * 6/1996 Wang ..... 180/65.1
5,540,296 * 7/1996 Strothmann ..... 180/19.3
5,657,828 * 8/1997 Nagamachi ..... 180/19.3
5,789,884 * 8/1998 Hancock ..... 318/280
5,969,495 * 10/1999 Cherry et al. ..... 318/685

* cited by examiner

*Primary Examiner*—Paul Ip
(74) *Attorney, Agent, or Firm*—Pro-Techtor International Services

(57) ABSTRACT

An electric carrier with a motor controlled by correlative positions includes an operator possible to be a person, a sensor controlled by the operator and having a position reference member driven by and moving together with the operator and a sensing body producing signal at any movement of the position reference member, a spring connected to the position reference member and disfigured by the operator's driving so that the position reference member may return to its position and transmit force to an electric carrier to be mentioned below, a controller operating by signal coming from the sensing body, a motor driven by the controller and accordingly having functions of speed increasing and decreasing clockwise and counterclockwise rotation, and the electric carrier moved by the motor and with the operator synchronously. When the operator changes its position relative to the electric carrier, the sensor sends signal to the controller, which then controls the electric carrier change its speed to the same speed of the operator.

9 Claims, 14 Drawing Sheets

(011)

(001)

(101)

(100)

(110)

| B1T2 | B1T1 | B1T0 |
|---|---|---|
| 0 | 1 | 1 |

| B1T3 | B1T2 | B1T1 | B1T0 |
|---|---|---|---|
| 0 | 1 | 1 | 1 |

| B1T4 | B1T3 | B1T2 | B1T1 | B1T0 |
|---|---|---|---|---|
| 0 | 1 | 1 | 1 | 1 |

| B1T2 | B1T1 | B1T0 |
|---|---|---|
| 0 | 1 | 1 |

| B1T4 | B1T3 | B1T2 | B1T1 | B1T0 |
|---|---|---|---|---|
| 0 | 1 | 1 | 1 | 1 |

ELECTRIC CARRIER WITH A MOTOR CONTROLLED BY CORRELATIVE POSITIONS

BACKGROUND OF THE INVENTION

This invention relates to an electric carrier with a motor controlled by a correlative position, particularly to one completely conforming humane driving capacity, with the speed of the electric carrier controlled by changing of the correlative position of the operator (such as a human person) and the thing controlled, and then the speed of the electric carrier may be altered in accordance with the speed of the operator. The electric carrier is moved by the motor, and there is a spring between the operator and the electric carrier, transmitting the force of the operator to the electric carrier. And the coefficient of the spring is chosen in such a way as the operator can control the electric carrier with a proper or no force. Then this electric carrier may have worthiness possible to be widely used in industries.

Generally speaking, conventional electric carriers with a motor controlled by the correlative positions nowadays have two ways of controlling its driving, an open route and a closed route.

The open route control, as shown in a block diagram of a flow chart in FIG. 1, has a controller for driving a motor, which directly moves an electric carrier. This kind of controlling way is simple and of low cost, but it can be applied to a narrow scope only. For example, if the electric carrier is a car running on land, the car can run very smoothly on a flat road, with the speed controlled by a controller coping with the car. But the car runs on an up or down slope, the motor cannot meet demand of the necessary speed, limited by the slope condition. Thus, the open route control mode is only suitable to an environment of little change or needing no particular condition.

As for the closed route control mode, referring to FIG. 2, has a difference that a speed meter is additionally provided in the open route control mode. The speed meter tests the speed of the motor and feeds the data to the controller controlling the motor so that the speed of the motor may be adjusted automatically to obtain stabilized speed of the motor. However, though the closed route control mode can guarantee to control the output of the motor, the object controlled is the motor, not the real thing to be controlled. Rigidity (such as the gap between gears) and load characteristic of the electric carrier may not be such as that calculated by theory, often produces large errors, so academies and scholars incessantly offer theory about motor control and its structure designs so as to acquire higher precision. But a new method may increase cost, not easily accepted by a non-consumer world.

SUMMARY OF THE INVENTION

This invention has been devised to offer an electric carrier with a motor controlled by correlative positions, completely conforming to humane nature, having the driving speed of the electric carrier synchronous with that of the operator, obtaining worthiness widely applicable to various industries.

The main feature of the invention is an operator, possible to be a human person and a sensor controlled by the operator, a controller driven by signal produced by the sensor controlled by the operator, a motor controlled by the controller, and an electric carrier driven by the motor. When the correlative position (or speed difference) of the electric carrier and the operator changes, the sensor immediately senses it and sends signal to the controller, which then controls the speed of the electric carrier to be increased or decreased, adjusting the speed of the electric carrier that of the operator. Thus this kind of structure can permit the electric carrier move with the synchronous speed as that of the operator so as to be widely utilized by various industries.

BRIEF DESCRIPTION OF DRAWINGS

This invention will be better understood by referring to the accompanying drawings, wherein.

DETAILED DESCRIPTION OF THE PREFERRED EMBODIMENTS

Figure 4:
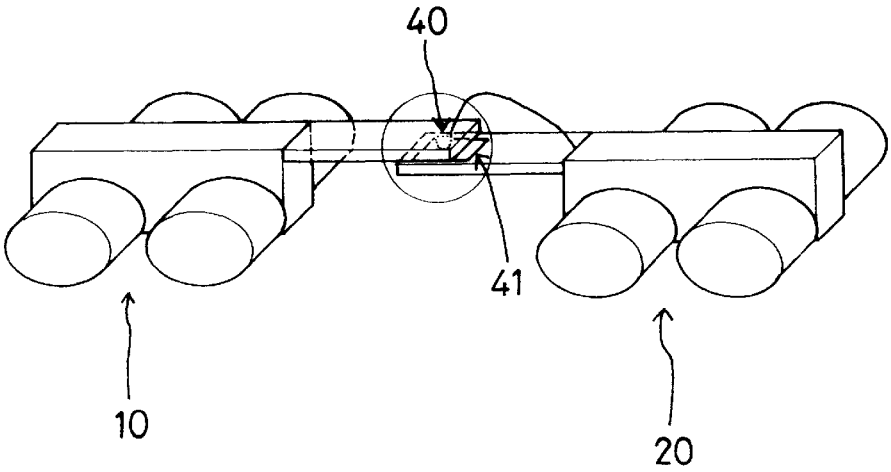
FIG. 4 is a diagram of a first embodiment of an electric carrier with a motor controlled by the corelative positions in the present invention, using two vehicles in motion.

A first embodiment of an electric carrier with a motor controlled by correlative positions, as shown in FIG. 4, includes a vehicle as an operator 10, another vehicle as an electric carrier 20, a position reference member 40 controlled by the operator 10 and located between the both 10 and 20, a sensor 41 affixed on the electric carrier 20, a controller receiving signal from the sensor 41, and a motor fixed on the electric carrier 20 and controlled by the controller.

The sensor 41 utilizes the correlative position of the electric carrier 20 and the main operator 10, transmitting proper command to the controller, which then controls the speed of the motor to be increased or decreased. When the operator 10 moves forward, the sensor 41 is driven, and next the controller, and the motor to move the electric carrier 20. In other words, the electric carrier 20 may be deemed as a subordinate, and when the correlative position between the operator 10 and the electric carrier 20 changes, the sensor 41 at once senses it and sends signal to the controller. Then the controller controls the speed of the subordinate to increase or decrease so that the speed of the operator and the subordinate may be synchronous. Although the subordinate can be considered to be a load the operator, the subordinate does not make up a load of the operator, and various practical things may be designed according to this idea. For example, the sensor, the controller, the motor may be such as to be used in the preferred embodiments described below.

Figure 5:
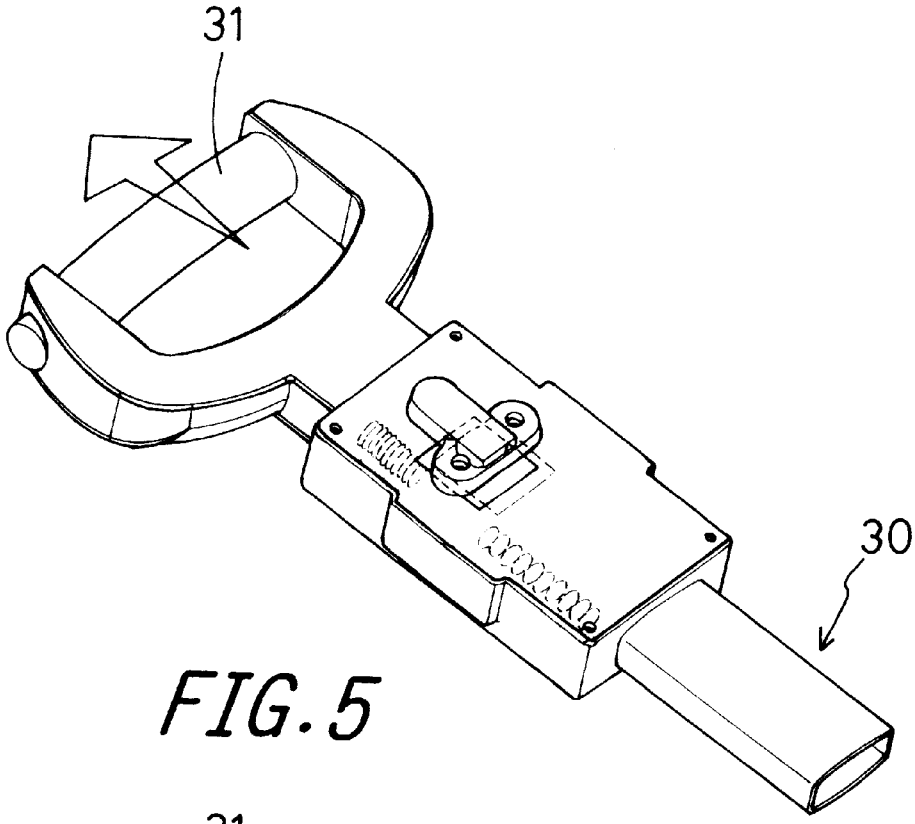
FIG. 5 is a perspective view of a second embodiment of an electric carrier with a motor controlled by the correlative positions in the present invention, utilized in the handle of a golf electric car to be pulled to control the speed of the golf electric car.
Figure 6:
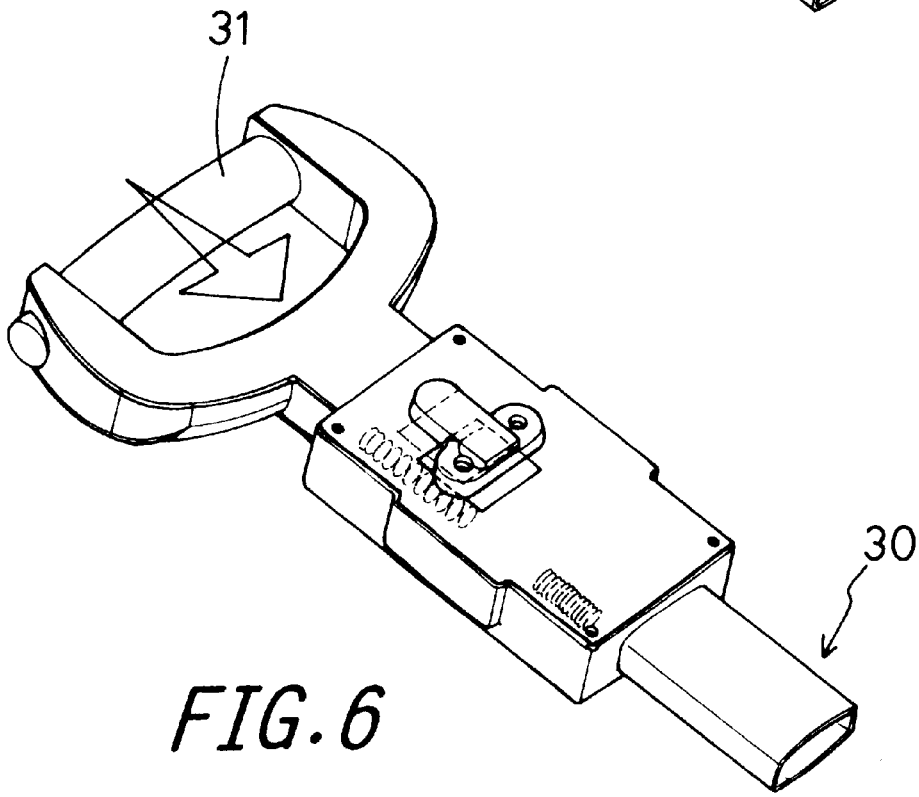
FIG. 6 is a perspective view of the handle pulled in the opposite direction to that shown in FIG. 5.
Figure 7:
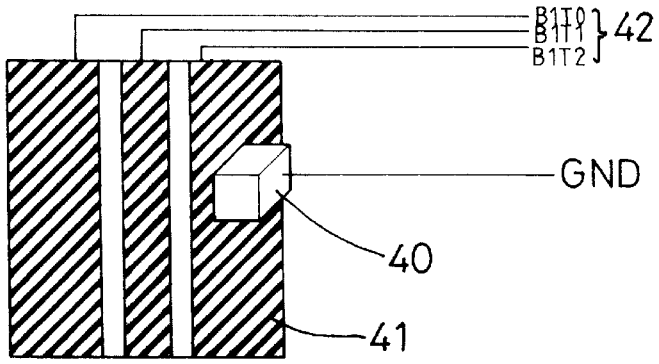
FIG. 7 is a view of stationary conditions of a first example of a sensor in the embodiment in the present invention.
Figure 8:
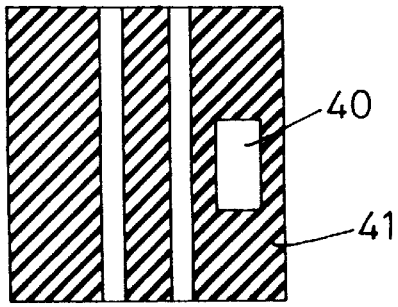
FIG. 8 is a view of dynamic changes and 1/0 points correlative conditions in FIG. 7.
Figure 8:
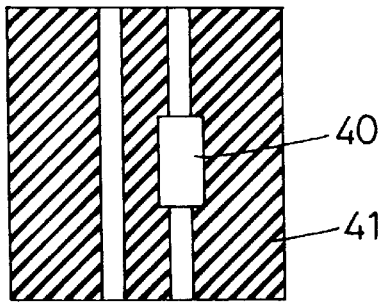
Figure 8:
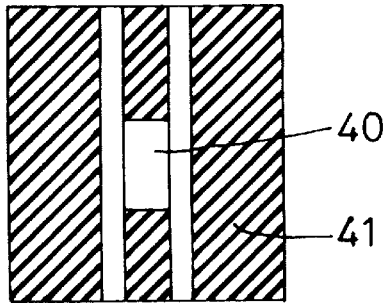
Figure 8:
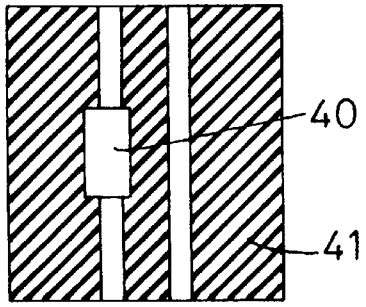
Figure 8:
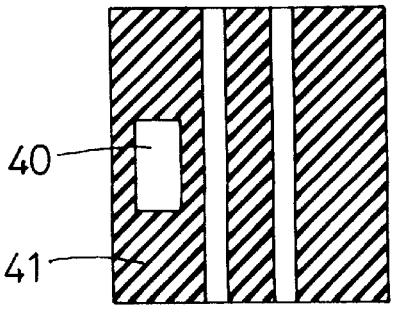
Figure 9:
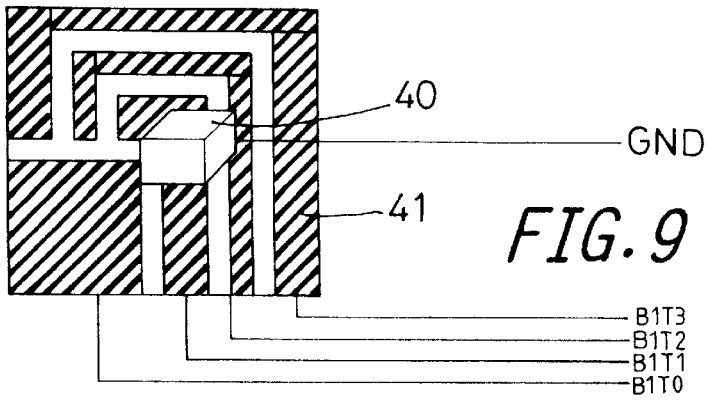
FIG. 9 is a view of stationary conditions of a second example of a sensor in the embodiment in the present invention.
Figure 10:
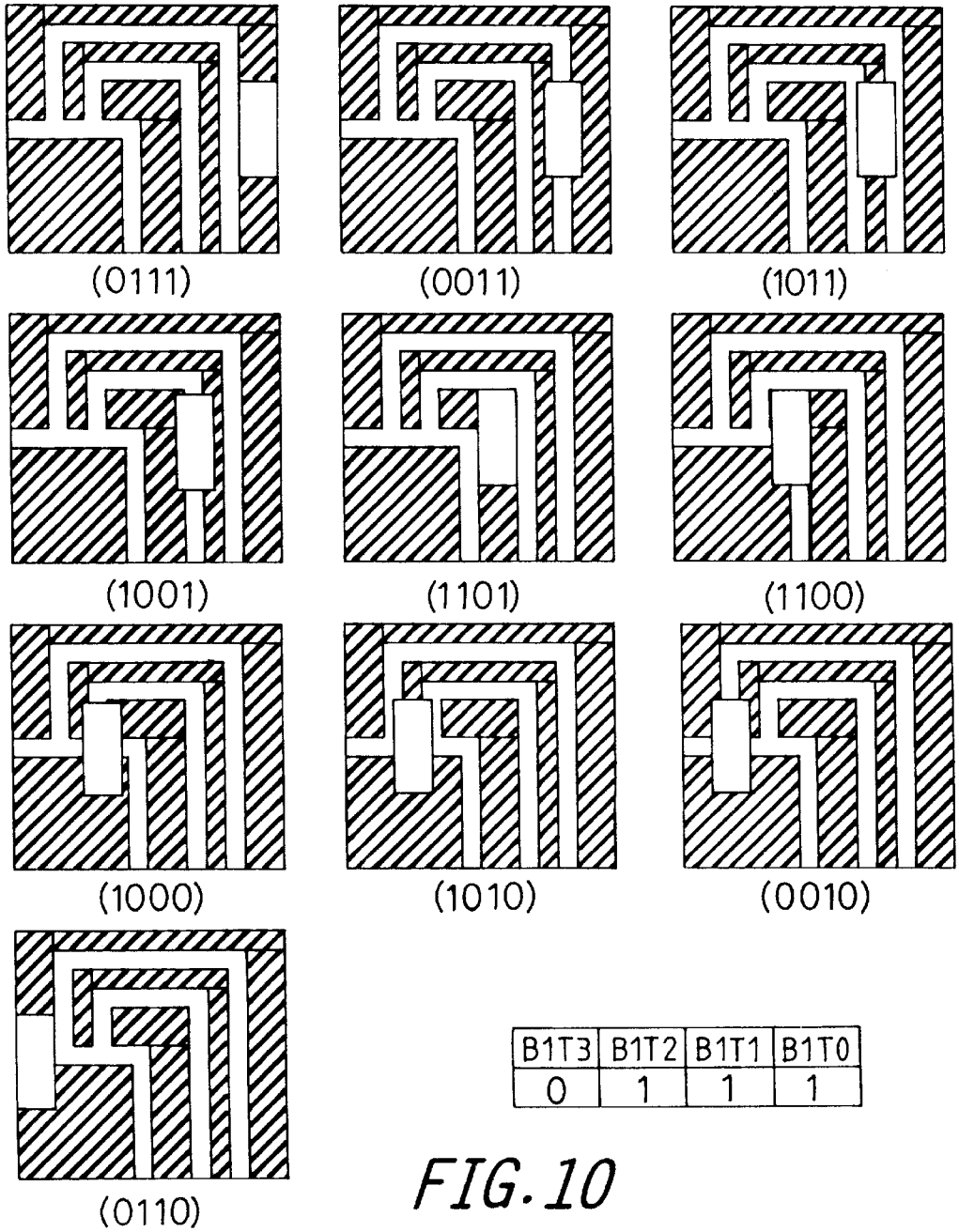
FIG. 10 is a view of dynamic changes and 1/0 points correlative conditions in FIG. 9.
Figure 12:
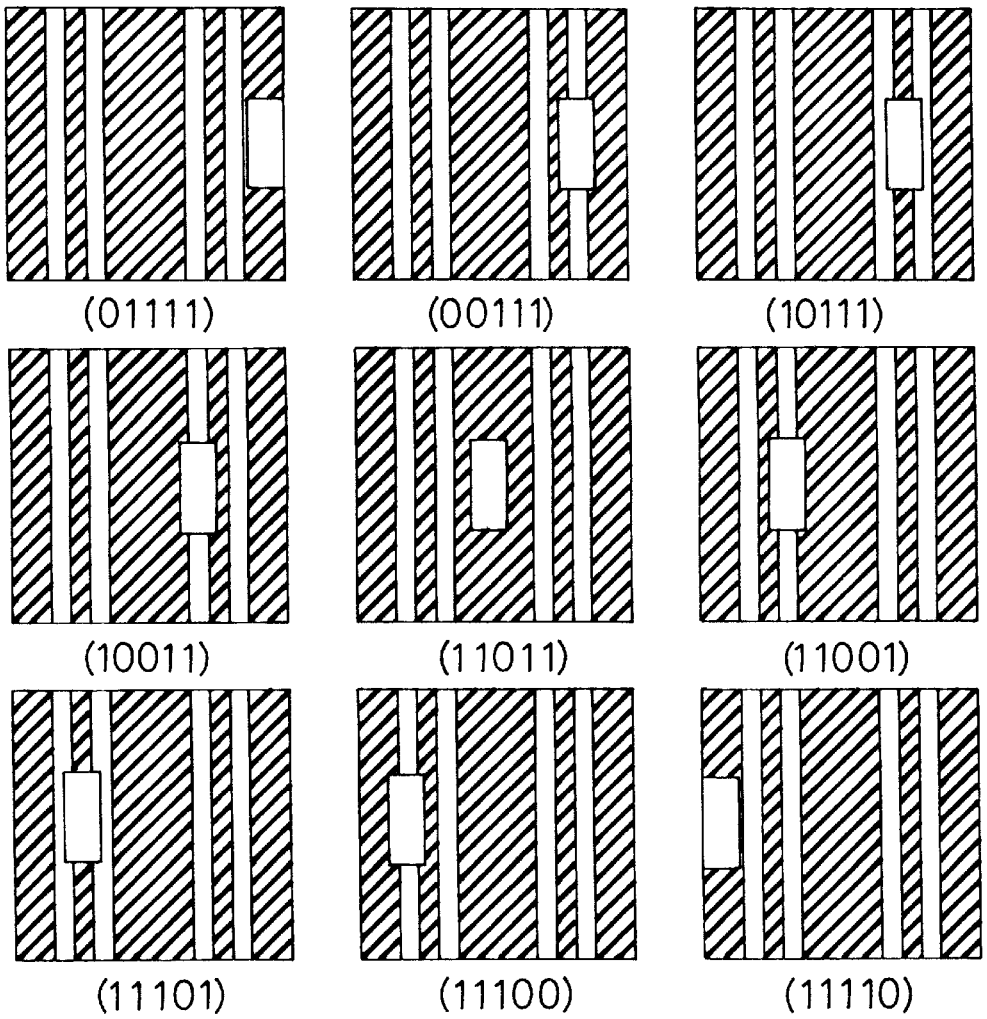
FIG. 12 is view of dynamic changes and 1/0 points correlative conditions in FIG. 11.
Figure 13:
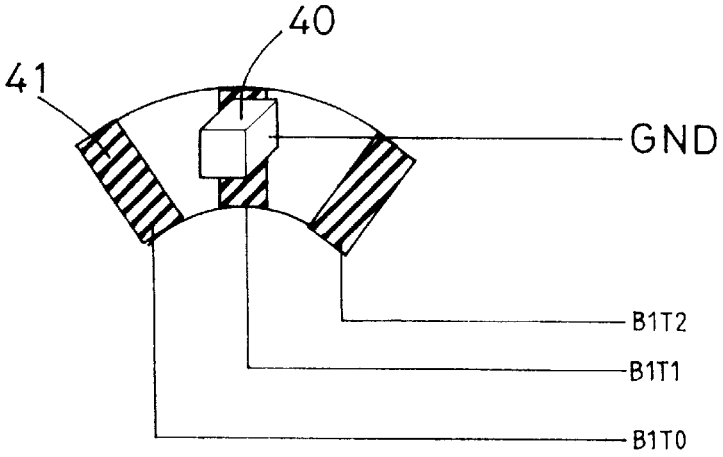
FIG. 13 is a view of stationary conditions of a fourth example of a sensor in the embodiment in the present invention.
Figure 14:
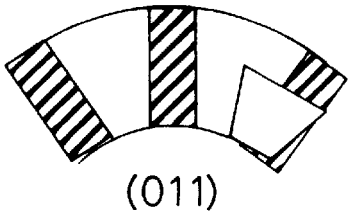
FIG. 14 is a view of dynamic changes and 1/0 points correlative conditions in FIG. 13.
Figure 14:
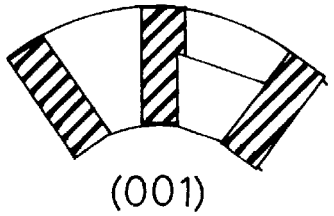
Figure 14:
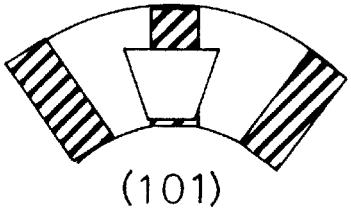
Figure 14:
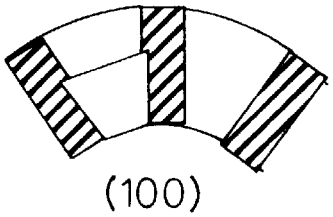
Figure 14:
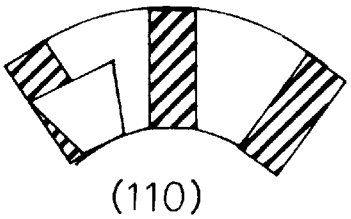
Figure 17:
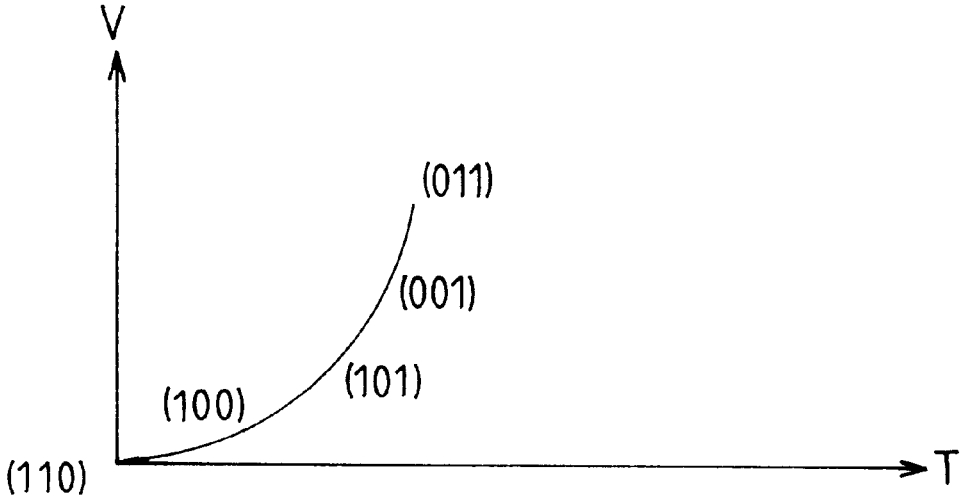
FIG. 17 is a graph of the speed set with the the first parameter and the position of the sensor shown in FIG. 7.
Figure 18:
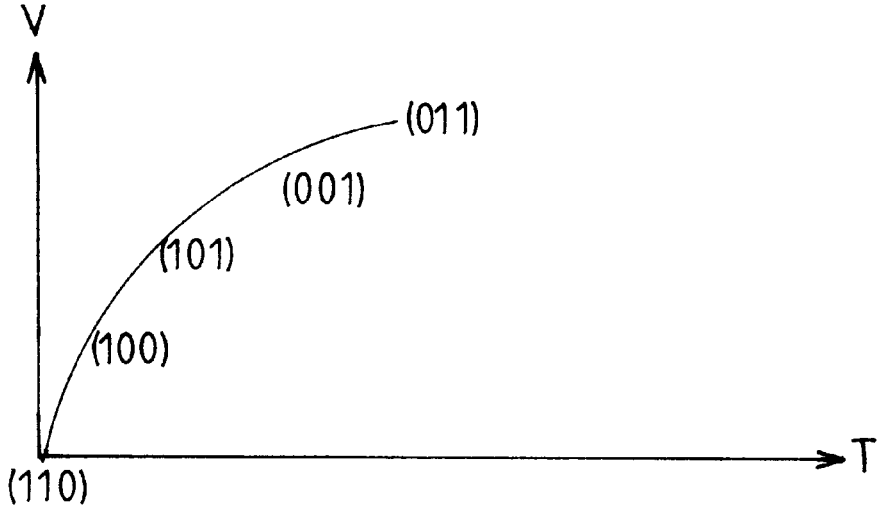
FIG. 18 is a graph of the speed set with the second parameter and the position of the sensor shown in FIG. 7.

Next, FIGS. 5 and 6 show a second embodiment of the invention, applied to a handle 31 of a golf electric car 30 for controlling the speed of the golf electric car. Its controlling mode is shown in FIGS. 7 and 8, includes a position reference member 40 (such as a carbon brush, a magnet, a photosensitive gate, a metal, etc.) pulling to move a handle 31, a sensor 41 (such as a printed electric circuit, a magnetic switch, a photosensitive switch, or a metal sensor) sensing the position of the position reference member 40 and sending out signal, and a controller 42 receiving signal from the sensor 41. The controller 42 may be a motor on the golf electric car to move the car. So the controller 42 may be considered to be a motor driver. Then FIG. 7 may be taken as a whole sensor, and for convenience of explanation, the position reference member 40 is considered as a carbon brush, and the sensor 41 a copper foil, and the carbon brush is a contact point (indicated as GND in FIG. 7. If the controller 42 has three 1/0 points BIT2, BIT1, BIT0 for sensing the carbon brush, and the carbon brush is designed to contact the copper foil, with the 1/0 point being low (0) or high(1), the three 1/0 points may have the five conditions (011), (001), (101), (100), and (110) as shown in FIG. 8, with the carbon brush being at a different position. Consequently the controller may have five increasing and decreasing ways and this ways are effected by relative coordination of the sensor 41 and the position reference member 40. Accordingly the sensor 41 may have many different shapes, not limited to only one shape, and more than five controlling ways in increasing and decreasing the speed can be designed, as shown in FIGS. 9, 11, 12, 15, 19 and 20 and may present more than five controlling conditions to increase and decrease the speed, as shown in FIGS. 10, 12, and 16. Or as shown in FIG. 13, the sensor 41 may be made curve-shaped and still have five ways to increase or decrease the speed as shown in FIG. 14. So different modes may have different ways to increase and decrease the speed to acquire comfortable feeling by utilizing different parameters. As in FIG. 18, with the horizontal axis being time and the vertical axis speed, if a user pulls the handle 31 of a golf electric car 30 and there are five ways of increasing and decreasing the speed as shown in FIG. 17, the motor of the electric golf car slowly starts to drive the car. On the contrary, if time T of the accelerating curve changes relative to speed V as shown in FIG. 18, the motor of the golf electric car 30 quickly starts.

To explain more minutely, utilizing alteration of the parameter (meaning inclination percentage of the relation between speed increasing and decreasing and time) can drive the motor slowly or quickly, and produce time change to acquire comfortable feeling in operating.

Figure 19:
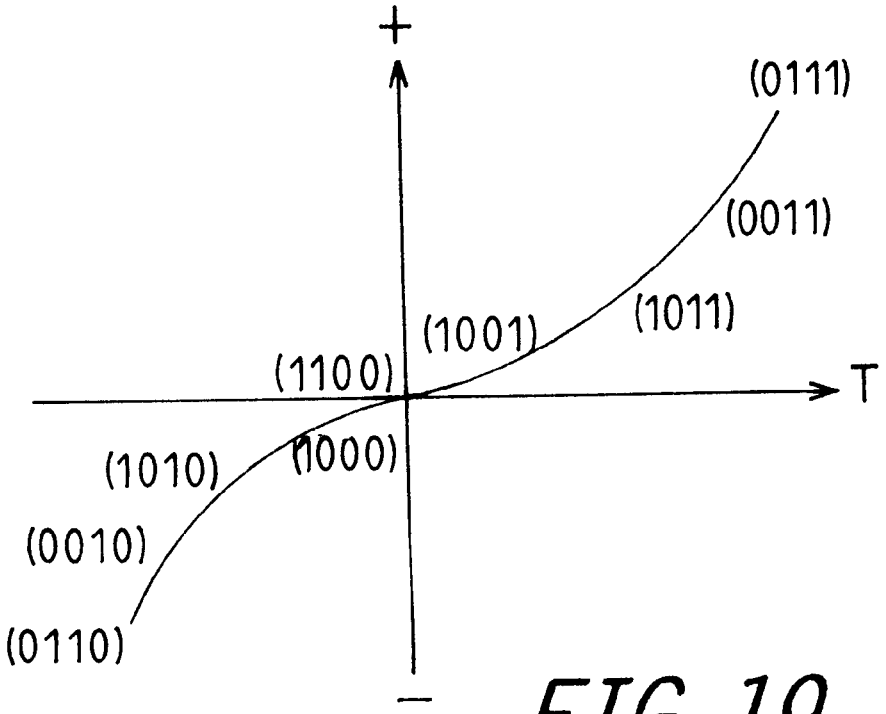
FIG. 19 is a graph of the speed and the position of the sensor shown in FIG. 9.
Figure 20:
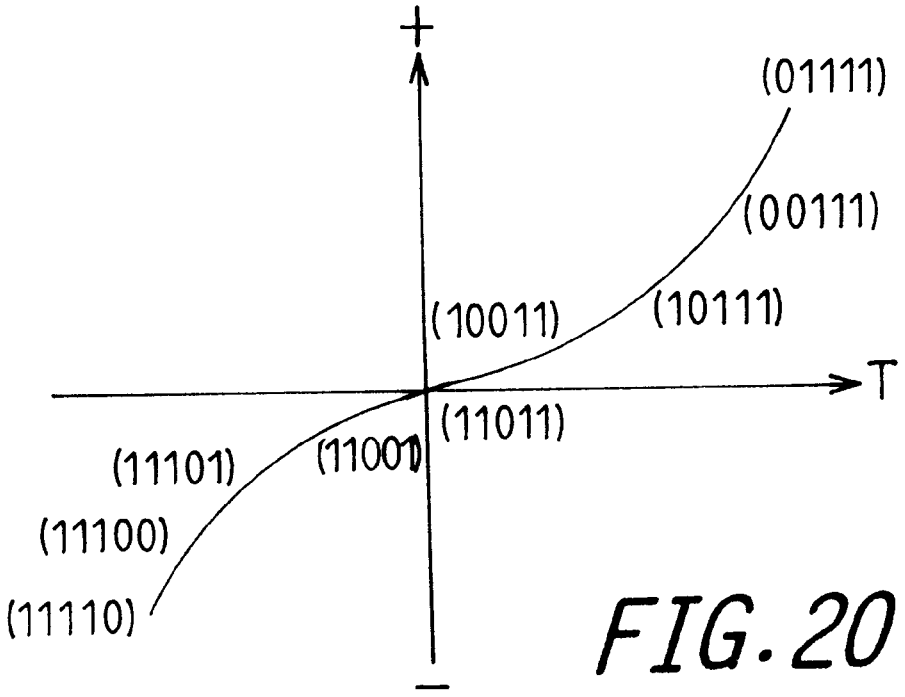
FIG. 20 is a graph of the speed and the position of the sensor shown in FIG. 11.

Basically, control of the aforesaid 1/0 point output signal can be accomplished by means of a micro processor, with a very high accuracy. At the same time, the micro processor can perform changes by different accelerating parameters, as shown in FIGS. 17, and 18, and different accelerating parameters may produce accelerating speed curves of different inclination percentage. The electric carrier needing soft start may use the parameter shown in FIG. 17, and that needing a large start torque may use the parameter shown in FIG. 18. In addition, 1/0 can be used to control clockwise or counterclockwise rotation of the motor, as shown in FIGS. 9 and 10, wherein the four 1/0 points have ten conditions, (0111), (0011), (1011), (1001), (1101), (1100), (1000), (11010), (0010), (0110). If the lowest bit BIT0 being low 0 is used for controlling two directional motion, its accelerating curve is as such as shown in FIG. 19, wherein + and − of the vertical axis in the figure indicate clockwise and counterclockwise rotation of the motor. In the same principle, setting different parameters for different modes can acquire different increasing and decreasing ways of speed.

Figure 11:
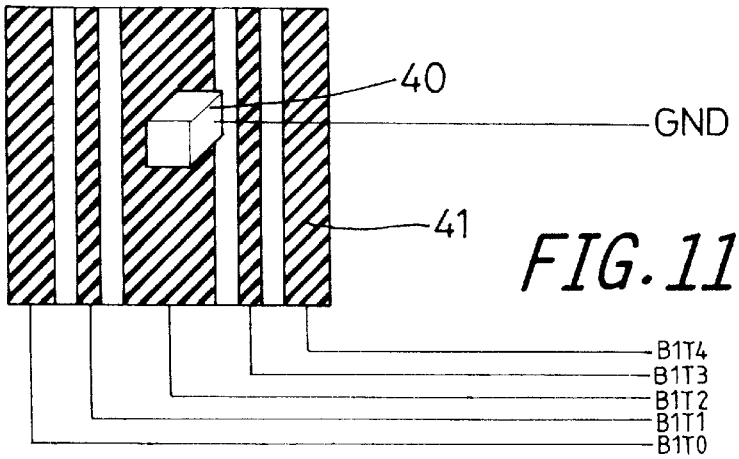
FIG. 11 is a view of stationary conditions of a third example of a sensor in the embodiment in the present invention.
Figure 15:
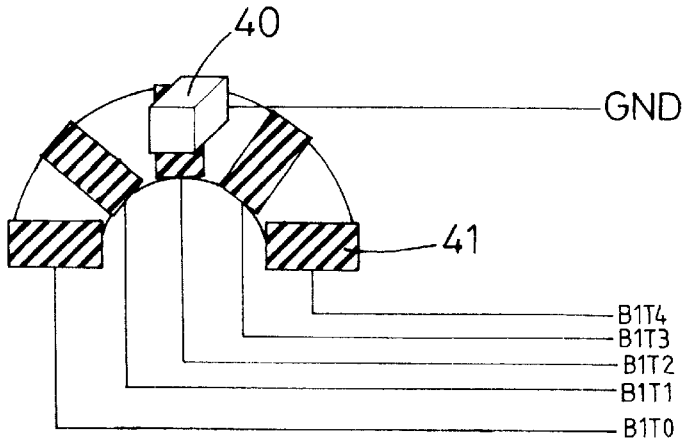
FIG. 15 is a view of stationary conditions of a fifth example of a sensor in the embodiment in the present invention.
Figure 16:
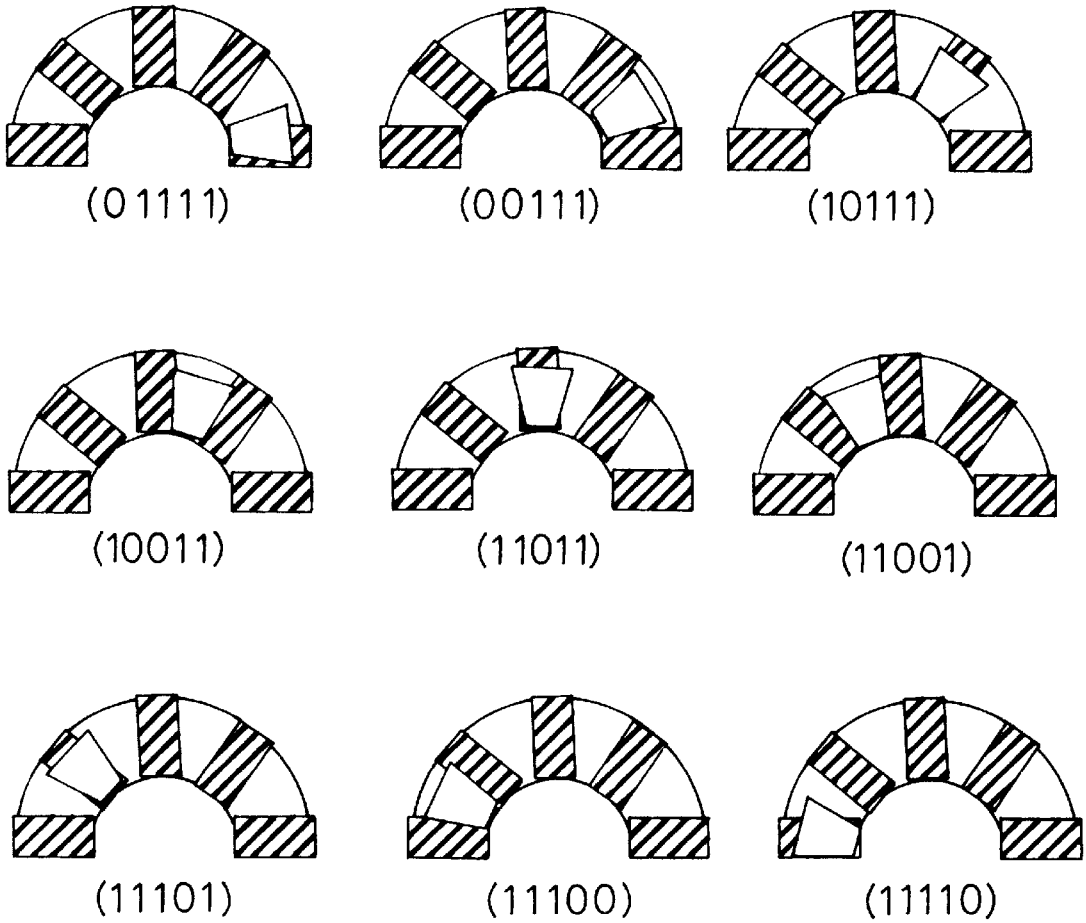
FIG. 16 is a view of dynamic changes and 1/0 points correlative conditions in FIG. 15.

If the controller has five 1/0 points for sensing the position of the carbon brush as shown in FIGS. 11, 15 and 16, the five points may have nine changes, (01111), (00111), (10111), (10011), (11011), (11001), (11101), (11100), and (11110). Setting of the parameter in coordination of the accelerating curve shown in FIG. 20 can acquire function for controlling clockwise and counterclockwise rotation of the motor.

As can be understood from the aforesaid description, if the operator is a person, (referring to FIG. 3 also) and the handle of the golf electric car is considered to be the sensor, the golf car can change its speed of the motor as that of the person by operating the handle, obtaining function of synchronous movement of the electric carrier with a person.

Figure 21:
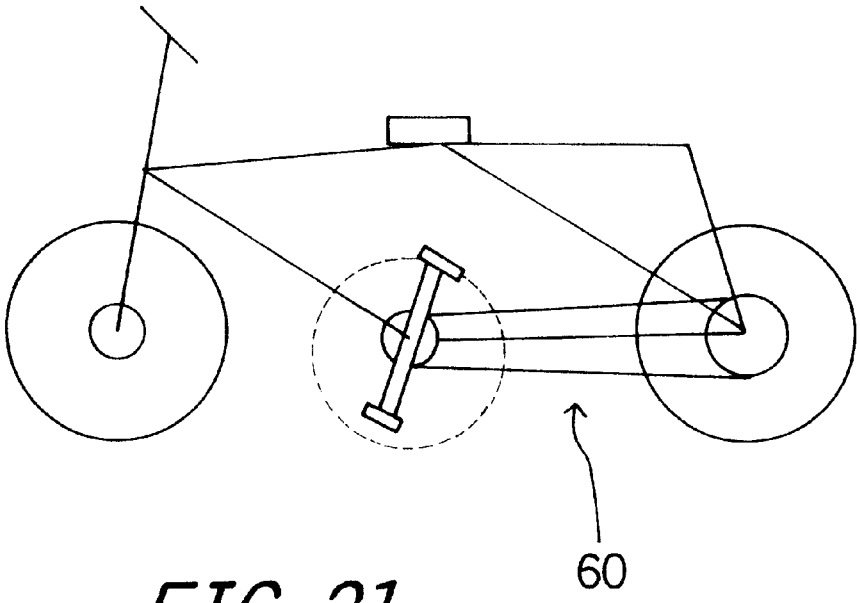
FIG. 21 is a side view of the third embodiment of the present invention applied to a bike for controlling its speed.
Figure 22:
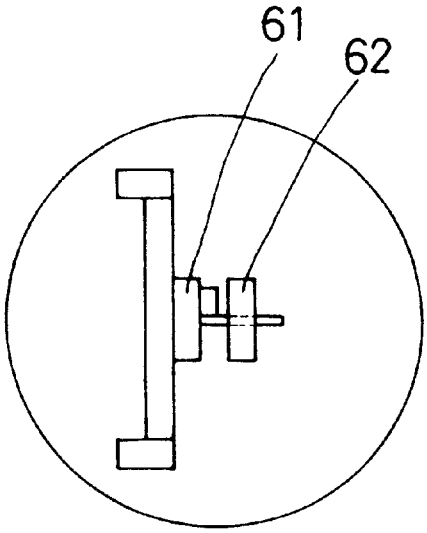
FIG. 22 is a magnified side view of the sensor shown in FIG. 13 applied to a bike.
Figure 23:
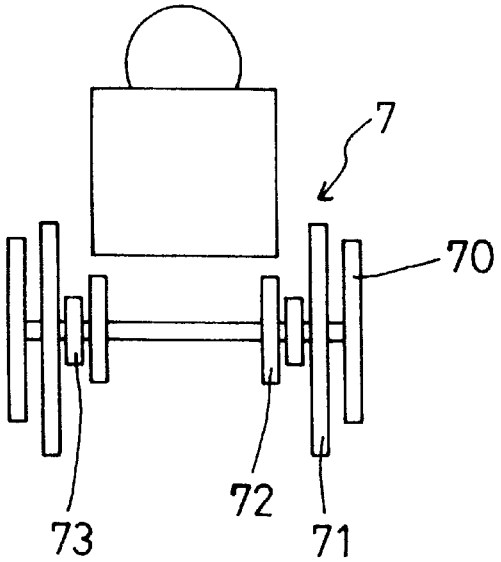
FIG. 23 is a view of the fourth example of the embodiment applied to a wheelchair for controlling its speed.
Figure 24:
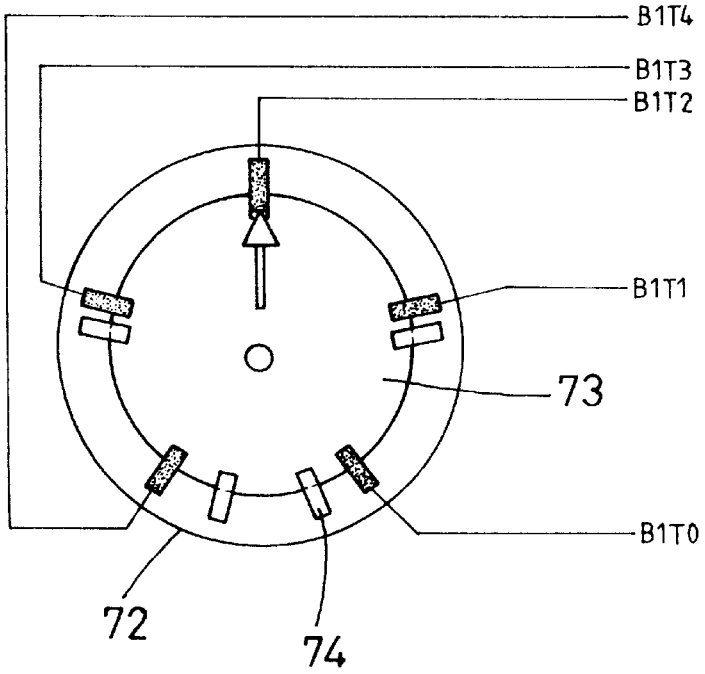
FIG. 24 is a front view of a magnetic switch used as a sensor in FIG. 23.
Figure 25:
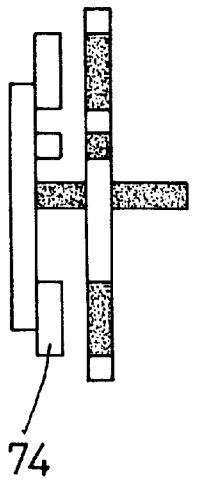
FIG. 25 is a side view of the magnetic switch used as a sensor in FIG. 23.
Figure 26:
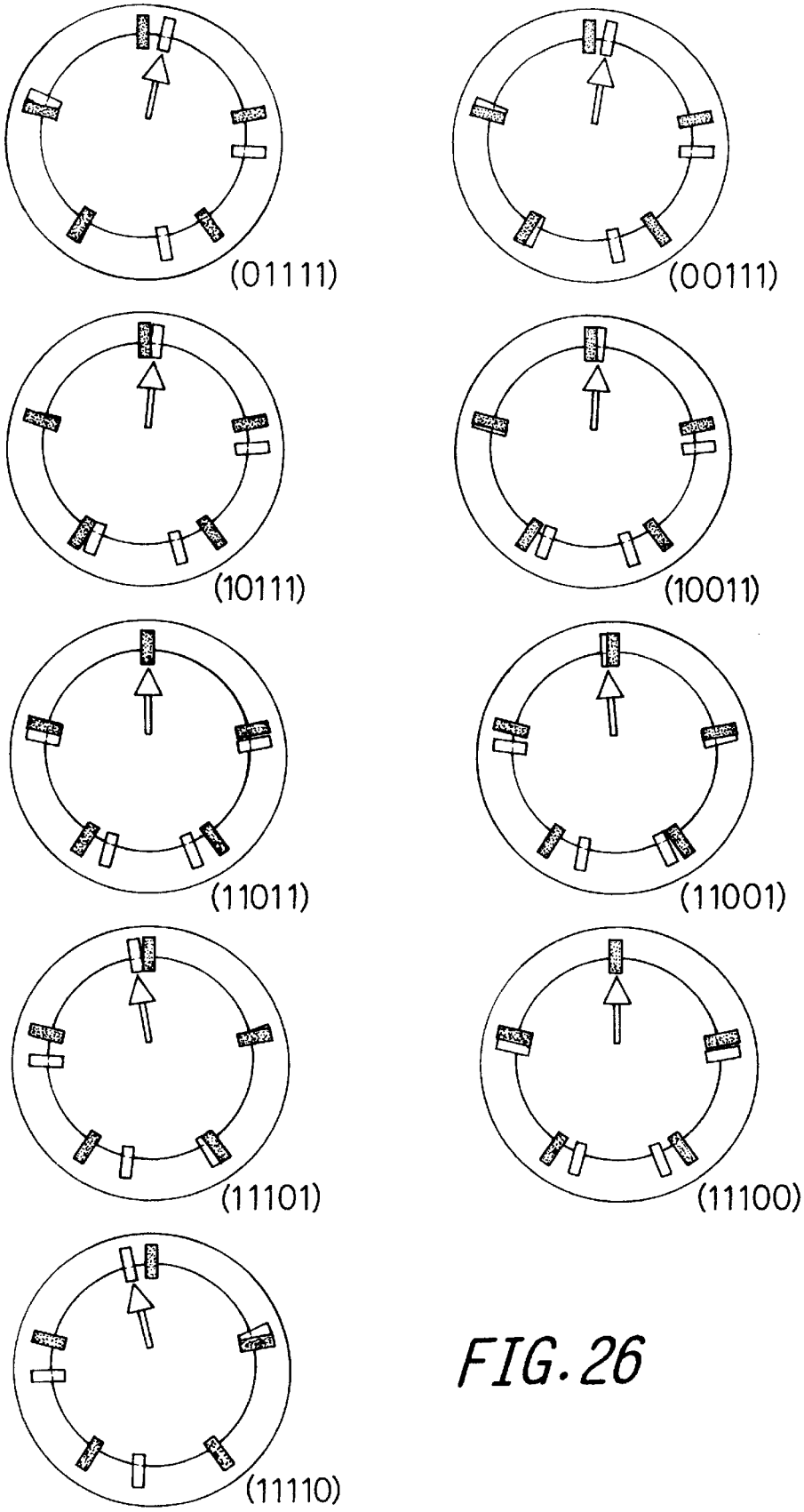
FIG. 26 is a front view of the dynamic changes of the magnetic switch shown in FIG. 24.

Besides, as shown in FIGS. 21 and 22, the speed controlling modes in the embodiment of the invention also can use a circular movement with coordination of the sensor shown in FIG. 13 or 15. So only changing the parameter can obtain function of driving. For example, the design of the circular movement control can be applied to a bike 60, utilizing relation of a pedal disc 61 and a disc 62 rotating together with the motor, letting the circular movement of the pedal disc 61 send an output to drive the motor in the multi-stage speed increasing and decreasing mode as shown in FIGS. 14 and 16. In practical design, the motor does not need counterclockwise rotation, as a bike runs only forward. So assistance by the motor can obtain function of supplementary movement for a bike, having a high practicality. This embodiment can also be applied to a wheelchair 7, which has two hand-pushed wheels 70, two rolling wheels 71, two unmovable discs 73, and two control discs 73 as shown in FIG. 23. The relative position of the unmovable discs 72 and the control discs 73 is shown in FIG. 24. The five 1/0 points may be replaced by five switches (such as non-contact magnetic switches), which are turned on by a magnet coming near the switches. So a magnet 74 can be placed at a special location of the magnetic switch as shown in FIGS. 24 and 25. Then if the magnetic switch has five 1/0 points and the control discs 73 in FIG. 24 have a bias to the corresponding discs, different magnets 74 can let different relative switches turn on. So only one or two magnetic switches coming near the magnet may be turned on because of the separate location angle of the switches. The dynamic changes and the 1/0 output are shown in FIG. 26. Thus, setting the parameter can acquire effect of different speed control.

Figure 1:
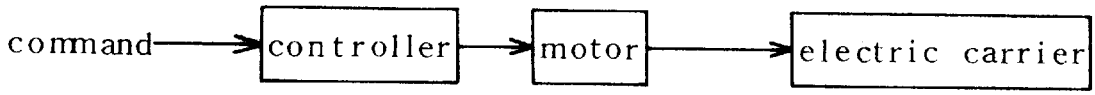
FIG. 1 (PRIOR ART)
FIG. 1 is a block flow chart of a conventional open route control.
Figure 2:
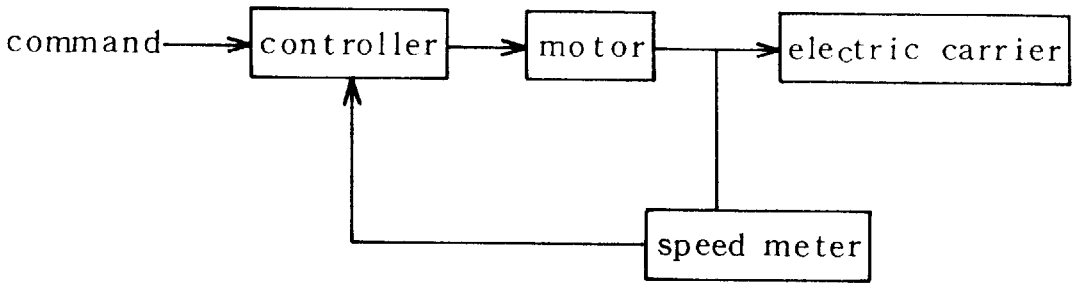
FIG. 2 (PRIOR ART)
FIG. 2 is a block flow chart of a conventional closed route control.
Figure 3:
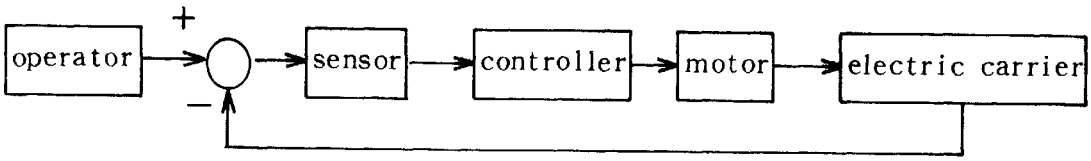
FIG. 3 is a block flow chart of a controlling a mode of an electric carrier with a motor controlled by the correlative positions in the present invention.
Figure 27:
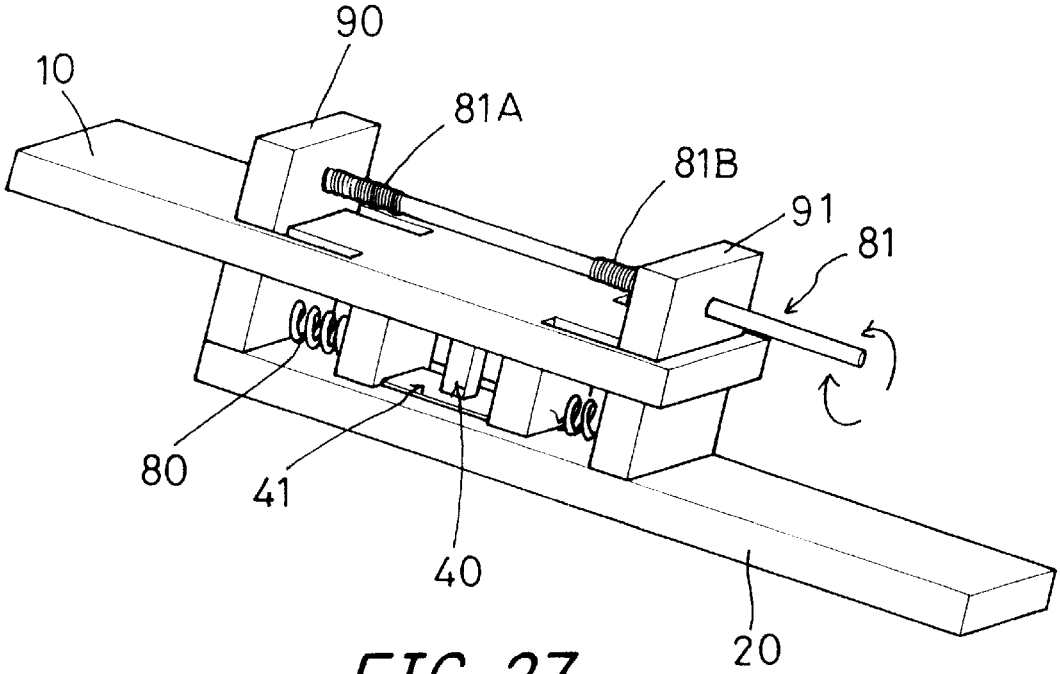
FIG. 27 is a perspective view of an embodiment in the present invention, showing springs added on the sensor when it is used for linear movement.
Figure 28:
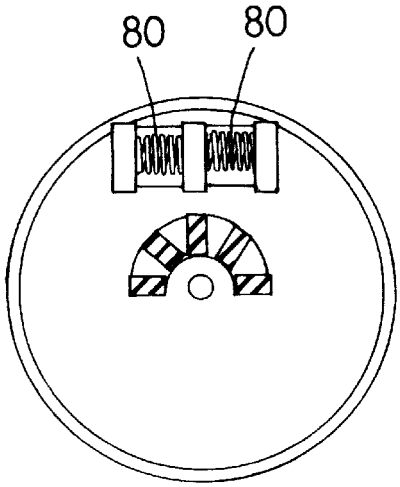
FIG. 28 is a front view of the embodiment in the present invention, showing springs added on the sensor when it used for circular movement; and, FIG. 29 is a side view of FIG. 28.
Figure 29:
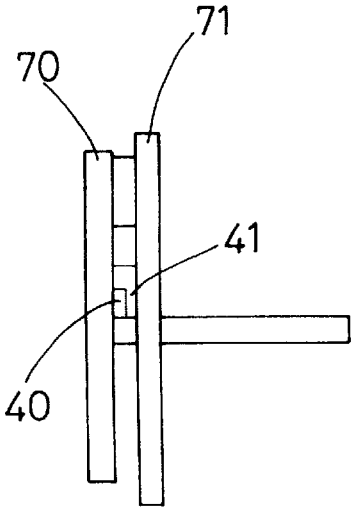

As can be understood from the aforesaid description, FIGS. 5, 21 and 23 show the operator or a person practically commands the speed, and its control flow chart is shown in FIG. 3. Therefore, whether the control capacity is good or bad can be perceived by the person, and the person can set the parameter according to the practical condition. If the three examples shown in FIGS. 5, 21 and 23 are set as an auxiliary mode, the person (or the operator 10) should make the subordinate (or the electric carrier 20, the golf electric car, or the hand-moved wheels 70 of the wheelchair) with his/her own force. In order to attain this, the position reference member 40 (such as a carbon brush) has to move together with the main operator 10, as shown in FIG. 27. And the sensor 41 (such as a sectional electric circuit board) has to move together with the subordinate (or the electric carrier 20), and springs 80 have to be provided between the sensor 41 and the subordinate, in spite of of linear or circular movement, as shown in FIGS. 27, 28 and 29. On one hand, the object is to permit the position reference member 40 automatically return to its position, not to be prevented by the pulling force of the operator 10, notwithstanding the pulling force being large or small. Then control stability may be secured. On the other hand, the pulling or pushing force of a person is to be transmitted to the electric carrier 20 (or the subordinate) via the springs 80. Interpreting this with mathematical extremity idea, when the springs 80 have the limitlessly large elasticity, the position reference member 40 stays at the zero or does not move. Then the motor also does not operate, and the electric carrier 20 is completely moved by the operator 10, forming a traditional vehicle without a power. On the contrary, if the springs 80 have limitlessly small elasticity, the position reference member 40 is totally controlled by the operator 10, but the force of the operator 10 is impossible to be transmitted to the electric carrier 20, which is then moved completely by the motor, becoming a real electric car. Thus choosing proper springs 80 (changing the coefficient K of the springs 80) can make a supplementing car movement. In the same way, the pushing wheels 70 of the wheelchair shown in FIG. 29 may be considered to be the operator 10, and the rolling wheels 71 to be the subordinate (or the electric carrier 20), the same driving effect will be gotten. In designing the structure, if the springs can be pressed with a preset pressure value (or adjusting its coefficient) as shown in FIG. 27, a threaded rod 81 with the front and the rear end respectively provided with a right-hand threads 81A and a left-hand threads 81B can be used, and the lefthand and the right-hand thread 81B and 81A respectively carry a front and a rear stop plate 90 and 91 pushed by the springs 80. When the threaded rod 81 is rotated, the stop plates 90, 91 are respectively shoved toward the center, compressing the springs 80. With is design, a user himself can adjust the assisting force of the motor depending on the body strength at that time, very practical to use.

It should be emphasized that the central ideology of the present invention is based on a human person, not on comfortable operation by a human person, not as on the motor without life that is used in conventional electric carriers. If the present invention is wanted to drive the electric carrier, the operator only resists the elasticity of the springs fixed on the carrier, accomplishing the effect of assisting movement often mentioned above in the description of the invention. Therefore, this invention has worthiness possible to be widely utilized in the market (such as on electric wheelchairs, golf electric cars, etc.). Although this invention uses a motor as power source, it is inevitable, and a human person feels that the movement of the object is controlled completely by himself, satisfying demand of the personified operation. So it is evident that the present invention is superior to conventional ones, which lack in personified designs and are liable to produce errors in controlling.

While the preferred embodiments of the invention have been described above, it will be recognized and understood that various modifications may be made therein and the appended claims are intended to cover all such modifications which may fall within the spirit and scope of the invention.

I claim:

1. A carrier driven by an electric motor comprising:

a sensor, said sensor includes a movable position reference member, a sensing body of said sensor producing a sensor signal in response to movement of said position reference member, a spring means connected to said position reference member, said spring means urges said position reference member toward a neutral position, a controller operated by said sensor signal generated by said sensing body, and said motor driven by said controller; wherein said motor drives said carrier, a speed and direction of drive of said motor being controlled by said controller, said spring means returning said position reference member to said neutral position when no force is applied to said position reference member such that there is no motion of said position reference member relative to said carrier, said motor therefore applying no drive to said carrier when said position reference member is in said neutral position.

2. The carrier of claim 1 wherein:

said position reference member is a carton brush.

3. The carrier of claim 1 wherein:

said position reference member is a magnet.

4. The carrier of claim 1 wherein:

said position reference member is a photo gate.

5. The carrier of claim 1 wherein:

said position reference member is a metal.

6. The carrier of claim 1 wherein:

said sensing body is a printed electric circuit board.

7. The carrier of claim 1 wherein:

said sensing body is a magnetic switch.

8. The carrier of claim 1 wherein:

said sensing body is a photosensitive switch.

9. The carrier of claim 1 wherein:

said sensing body is a metal sensor.

* * * * *